United States Patent [19]

Woods

[11] 4,112,612

[45] Sep. 12, 1978

[54] CONVERTIBLE AERIAL PROJECTILE TOY

[76] Inventor: William W. Woods, 901 Grayland St., Greensboro, N.C. 27408

[21] Appl. No.: 770,599

[22] Filed: Feb. 22, 1977

[51] Int. Cl.[2] ..... A63H 27/00

[52] U.S. Cl. ..... 46/74 D; 273/106 B

[58] Field of Search ..... 46/74 D; 273/106 R, 273/106 B

[56] References Cited

U.S. PATENT DOCUMENTS

| | | | |
|---|---|---|---|
| 3,185,480 | 5/1965 | Weyman et al. | 273/106 B |
| 3,312,472 | 4/1967 | Kerr | 46/74 D |
| 3,566,532 | 3/1971 | Wilson | 46/74 D |

*Primary Examiner*—Louis G. Mancene

*Assistant Examiner*—Robert F. Cutting

[57] ABSTRACT

A toy of the type which is designed to be tossed, thrown, or sailed through the air by hand includes a circular, lightweight plastic or rubber disc and a plurality of surface configuration modifying structures which may be selectively secured to the disc to predictably affect the aerodynamics around the disc during flight. The disc is self-supporting and has a centrally positioned circular opening therethrough. The flight altering structures include a funnel-type device, cup-shaped device, and a pair of fins. The funnel device and the cup-shaped device are selectively attached to one side of the disc in a position centered with respect to the circular opening. The fins are attached to opposing peripheral edges of the disc.

9 Claims, 8 Drawing Figures

FIG. 1
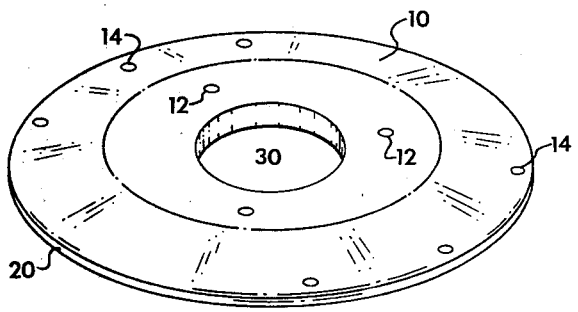
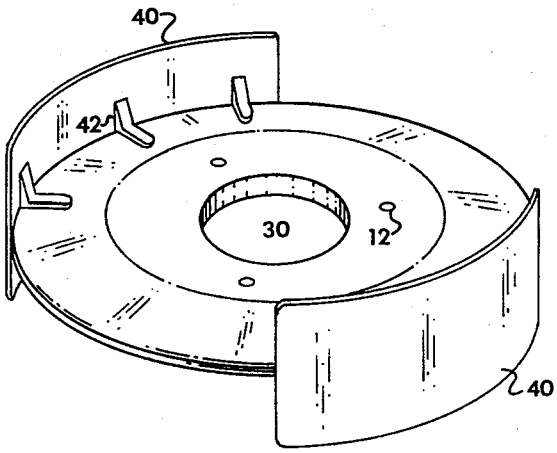
FIG. 2
FIG. 3
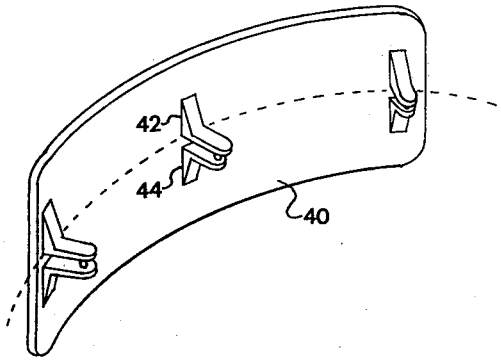
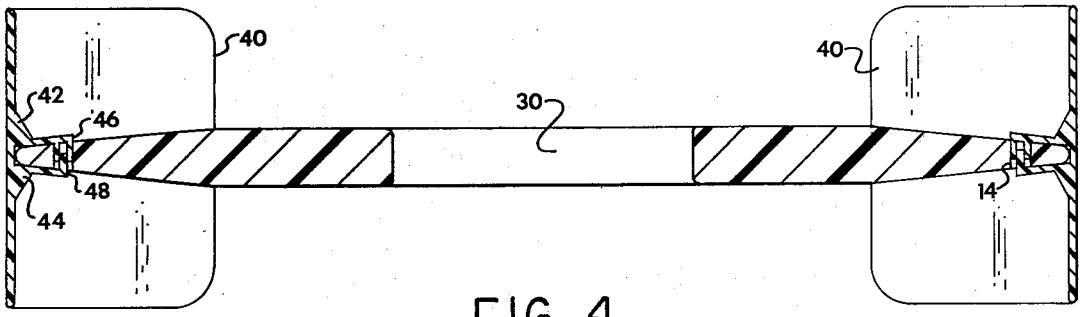
FIG. 4

CONVERTIBLE AERIAL PROJECTILE TOY

BACKGROUND OF THE INVENTION

Disc-type projectile toys and sports devices have become increasingly popular during the last few years, partially due to their inherent advantage of being easily carried from one area to another for providing entertainment in a person's own back yard or at picnic grounds, beaches, etc. Probably the best known of these devices is the device sold under the trademark "Frisbee", but other known toys of this type include U.S. Pat. No. 3,312,472 to Kerr; U.S. Pat. No. 3,556,532 to Wilson; and U.S. Pat. No. 3,553,884 to Dunstand.

Each of these toys is of the type adapted to be thrown or sailed through the air from one person to another with the objects being to maintain flight or "hang" time, increase distance of travel, and/or land the projectile at a given point. Each of the above-named patents include modifications to a basic disc-type projectile directed to improving the aerodynamic characteristics of the air flow path over and around the disc for the objects set forth above. However, none of the above devices are directed to the versatility of the toy, such as that obtained by providing selectively interchangable attachments which may be secured to the disc member for altering the flight pattern of the toy, thereby increasing its versatility and game objectives.

SUMMARY OF THE PRESENT INVENTION

The present invention is directed to an aerial projectile toy which includes a self-supporting, circular, relatively lightweight disc member to which may be selectively secured one of several different flight altering structures. During play the disc, with one of the structures secured thereon, is tossed or sailed through the air from one person to another person or from one person to a designated landing point. The toy is simple in construction and generally made from the lighter weight, self-supporting but flexible plastics or rubber. It is safe for use by young children and may also be enjoyed by adults.

The aforementioned removable structures include a plurality of devices which may be snapped on or otherwise temporarily secured to the disc member for altering the path of flight. A pair of peripheral fins which are secured to diametrically opposing edges of the disc form one such structure. A conical-shaped housing secured to the surface of the disc, and a cup-shaped housing also secured to the disc are others.

The disc itself is a generally circular, flat, lightweight device preferably made from a pressed or molded soft plastic or rubber material. The disc includes a circular opening through the center thereof to permit the entrance of air into the funnel or cup housing positioned thereon. The edge of the disc provides a gripping means enabling a participant to exercise more control in sailing or catching the projectile. The edge is of a softened material to serve as a safety device in that there are no sharp edges which could injure a participant if struck by the device. Alternatively, the edge might be provided with a protective bead or lip for safety purposes.

The provision of multiple attachments in various shapes and sizes and which are easily snapped on or off the disc, offers a participant a variety of game objectives while playing with the projectile. In use, the disc is sailed across any open area with its flight characteristics varying widely according to the selected attachment thereby providing an assortment of game possibilities.

It is therefore an object of the present invention to provide an aerial projectile toy with a surface configuration that may be selectively modified to vary the path of flight.

It is a further object of the present invention to provide an aerial projectile toy with selectively attachable flight altering structures which alter the surface configuration to provide a variety of flight path possibilities.

Other objectives and a fuller understanding of the present invention will become apparent while studying the detailed description in conjunction with the accompanying drawings of which:

FIG. 1 is a perspective view of the basic disc according to the present invention;

FIG. 2 is a perspective view of a first embodiment of the present invention illustrating the peripheral fin arrangement;

FIG. 3 is a perspective view of a fin used in the embodiment of FIG. 2;

FIG. 4 is a cross-sectional view taken substantially along lines 4—4 of FIG. 2;

DETAILED DESCRIPTION OF A PREFERRED EMBODIMENT

Figure 5:
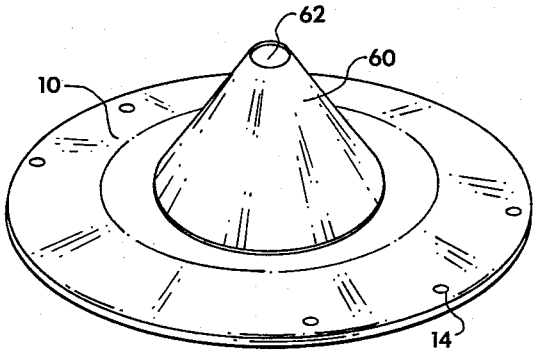
FIG. 5 is a perspective view according to a second embodiment looking from the underneath side.

Turning now to the drawings in FIG. 1 the basic disc 10, upon which all flight altering structures are releasably attached, is illustrated. The disc 10 is formed from a soft moldable plastic or rubber material which is light in weight and somewhat flexible. The material must be rigid enough to be self-supporting, but it is undesirable for it to be so rigid as to break easily or injure a person accidentally struck by the toy during play. The size of the disc 10 is not vital to its flight characteristics but in the preferred embodiment it is approximately 7 to 12 inches in diameter. The size may vary, but if made substantially smaller than the 7 inch diameter it may have insufficient aerodynamic qualities, particularly lift, or it may be difficult to grip and toss. If it is significantly larger than the diameter of 11 to 12 inches, the resulting lift achieved may make aerodynamic characteristics of the disc increasingly difficult to alter from flight to flight. The thickness may vary depending on the material but generally a thickness of $\frac{3}{8}$ inch near the center tapering to $\frac{1}{8}$ inch near the periphery is preferred.

As further seen in FIG. 1 the disc 10 includes a rim 20 and a relatively large central opening 30 preferably of a diameter approximately one-fourth to one-third as great as the diameter of disc 10. However, this may vary somewhat depending on the weight and thickness of the disc. A plurality of smaller openings 12,14 provide a means on the disc 10 for attaching the structures.

FIGS. 2–8 illustrate the assorted flight altering structures 40, 60, 70 which may be selectively attached to the base disc 10 for varying the flight pattern of the projectile. Looking specifically at FIGS. 2–4, the disc 10 is shown with a pair of fins 40 attached to the outer edge thereof. The fins 40 are arcuate sections with the radius of the curve approximately the radius of disc 10. So constructed the rim 20 of the disc may be centered and snugly fitted against the inner surface of the fin.

Turning to FIGS. 3 and 4, each of fins 40 are provided with some type of releasable attaching means whereby the fins may be selectively attached and removed from disc 10. Illustrative of one example, such attaching means would include upper and lower tabs 42,44 molded integrally with fin 40 and which extend radially inward from the inner surface of the fin at either end thereof. A projection or bead 46 depends from tab 42 and is of such size as to be snap fit into one of openings 14 in disc 10. A similar bead 48 extends upwardly from tab 44 and is snapped into the adjacent opening 14 from the opposite side. For this purpose tabs 42 and 44 should be arcuately offset from each other. A pair of opposed clips 52,53 protruding from the wall 54 of fin 40 midway between the ends thereof snap over the rim 20 of disc 10 to prevent slippage of the fin 40 during use. The aforementioned is exemplary only of one means for attaching fins 40 to disc 10, and there are others which will function equally well.

In the preferred embodiment each fin has a vertical depth of approximately 2 inches and an arcuate length equivalent to approximately one-fourth the total circumference of the disc 10. Therefore, when both fins are positioned in place they intermittently surround approximately one-half the total outer periphery of the disc 10.

Figure 6:
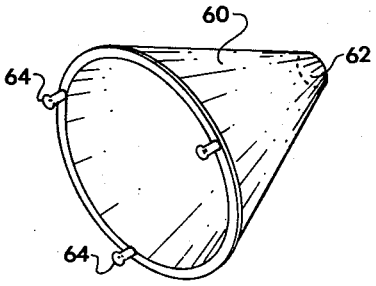
FIG. 6 is a perspective view of the cone structure used in the embodiment of FIG. 5.

FIGS. 5 and 6 illustrate the cone-shaped structure 60, open at the apex, snapped on to the surface of disc 10 around opening 30. The cone-shaped structure 60 is centrally positioned around the opening 30 so that when the projectile is in flight, air enters the opening 30 and is partially trapped or compressed inside the cone 60 until it exits at the apex opening 62 to alter the aerodynamic characteristics of the flight path. Obviously, the diameter of the base of cone-shaped structure 60 is greater than the diameter of opening 30. Though not essential to the invention the structure 60 in the preferred embodiment is attached to the disc 10 by means of a cooperative locking means which includes beaded posts 64 projecting from the edge of the cone and which snap through openings 12 in the disc 10 and are releasably held therein by means of the beaded configuration.

Figure 7:
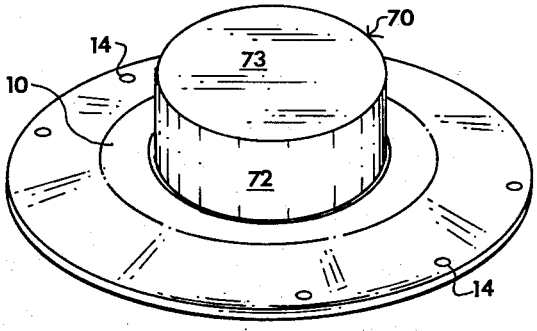
FIG. 7 is a perspective view according to a third embodiment, looking from the underneath side.
Figure 8:
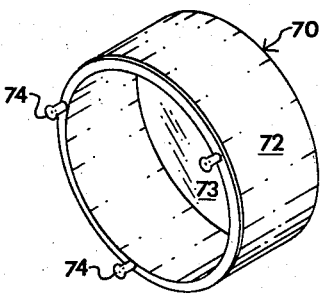
FIG. 8 is a perspective view of the cup-shaped structure used in the embodiment of FIG. 7.

FIGS. 7 and 8 illustrate the third embodiment of the flight altering structures which includes a cup-shaped device 70 having its open end centrally positioned around the opening 30 of the disc 10 as in the case of the cone-shaped structure 60. The cup structure 70 includes a cylindrical side wall 72, a circular outer wall 73, and an open opposite end. During the projectile flight air enters the opening 30 and is trapped within housing 70, thus creating at least a third unique flight characteristic of the projectile. As in the cone-shaped structure 70, a plurality of beaded tabs 74 provide a means for releasable attachment to disc 10 through openings 12.

It is anticipated under the present invention that the aerial projectile toy will be marketed in the form of kits having at least the disc 10 with two or three flight altering attachments 40, 60, 70. Possibly two discs 10 of a different diameter may be provided. There may be variations in the size or shape of the fins, the cups, and the funnels which are provided with the disc 10 so that a nearly unlimited numbr of flight characteristcs may be created depending upon the shape of the attached structure. Further, the attachments 40, 60, 70 may be perforated for even further flight differences.

Various changes and modifications may be made to the embodiments set forth hereinabove without departing from the scope of the invention, which is set forth in the following claims.

What is claimed is:

1. An aerial projectile toy comprising:

(a) a substantially circular disc formed of a self-supporting, relatively soft, lightweight, moldable material;

(b) a plurality of flight altering structures, each of which, when attached to said disc, provides predictable aerodynamic characteristics of the air flow path around and over said disc during flight which differ from such characteristics achieved with the other of said structures;

(c) cooperative means on said disc and said flight altering structures for releasably temporarily securing selected ones of said structures at a time to said disc.

2. An aerial projectile toy according to claim 1 wherein the edge of said disc includes a means for preventing injury associated therewith.

3. An aerial projectile toy according to claim 1 wherein said disc further includes an air opening through the center thereof.

4. An aerial projectile toy according to claim 3 wherein said air opening is substantially circular with a diameter substantially equivalent to one-fourth to one-third of the diameter of said disc.

5. The toy according to claim 4 wherein one of said flight altering structures comprises a pair of arcuate fin members extending transversely to the plane of said disc and arranged diametrically opposite each other around a portion of the periphery of said disc.

6. The toy according to claim 5 wherein each of said fin members has an arcuate length of approximately one-fourth of the circumference of said disc.

7. The toy according to claim 4 wherein one of said flight altering structures comprises a cylindrical cup-shaped member attached to one of said discs, the diameter of said structure being greater than and surrounding the diameter of said opening, whereby the center of said disc and the center of said opening both lie in the axis of said cylindrical member.

8. The toy according to claim 4 wherein one of said flight altering structures comprises a conical shaped member attached to one side of said disc, the diameter of the base of said structure being greater than and surrounding the diameter of said opening, whereby the center of said disc and the center of said opening both lie along the axis of said conical member.

9. The toy according to claim 8 wherein said conical member is truncated with the smaller end being open.

* * * * *